US005335864A

United States Patent [19]

Romann et al.

[11] Patent Number: 5,335,864

[45] Date of Patent: Aug. 9, 1994

[54] FUEL-INJECTION VALVE

[75] Inventors: Peter Romann, Stuttgart; Ferdinand Reiter, Markgroeningen; Martin Maier, Moeglingen, all of Fed. Rep. of Germany

[73] Assignee: Robert Bosch GmbH, Stuttgart, Fed. Rep. of Germany

[21] Appl. No.: 30,188

[22] PCT Filed: Jun. 10, 1992

[86] PCT No.: PCT/DE92/00477

§ 371 Date: Mar. 17, 1993

§ 102(e) Date: Mar. 17, 1993

[87] PCT Pub. No.: WO93/02285

PCT Pub. Date: Feb. 4, 1993

[30] Foreign Application Priority Data

Jul. 17, 1991 [DE] Fed. Rep. of Germany ..... 4123692

[51] Int. Cl.[5] ..... F02M 51/06

[52] U.S. Cl. ..... 239/585.1; 239/600

[58] Field of Search ..... 239/585.1–585.5, 239/533.12, 596, 600

[56] References Cited

U.S. PATENT DOCUMENTS 1,589,247 6/1926 Scott ..... 239/533.9
4,030,668 6/1977 Kiwior ..... 239/585.4
4,934,653 6/1990 Gried et al. ..... 239/585.1 X
4,971,254 11/1990 Daly et al. ..... 239/585
5,002,231 3/1991 Reiter et al. .

FOREIGN PATENT DOCUMENTS 3841142 6/1990 Fed. Rep. of Germany .
2225809 6/1990 United Kingdom ..... 239/533 R

*Primary Examiner*—Andres Kashnikow
*Assistant Examiner*—Kevin Weldon
*Attorney, Agent, or Firm*—Edwin E. Greigg; Ronald E. Greigg

[57] ABSTRACT

A fuel-injection valve having a metallic perforated disc arranged on a valve-seat body downstream of a valve-seat. The perforated disc arranged on the valve-seat body is supported by a supporting disc which is provided with a passage orifice and which is thicker than the perforated disc. This effectively prevents an undesirable bending of the perforated disc and at the same time improves the fuel treatment at the spray orifices. The supporting disc is made pot-shaped and is welded, together with the perforated disc, to the valve-seat body by a continuous welding seam. The fuel-injection valve is used in fuel-injection systems of mixture-compressing spark-ignition internal-combustion engines.

4 Claims, 1 Drawing Sheet

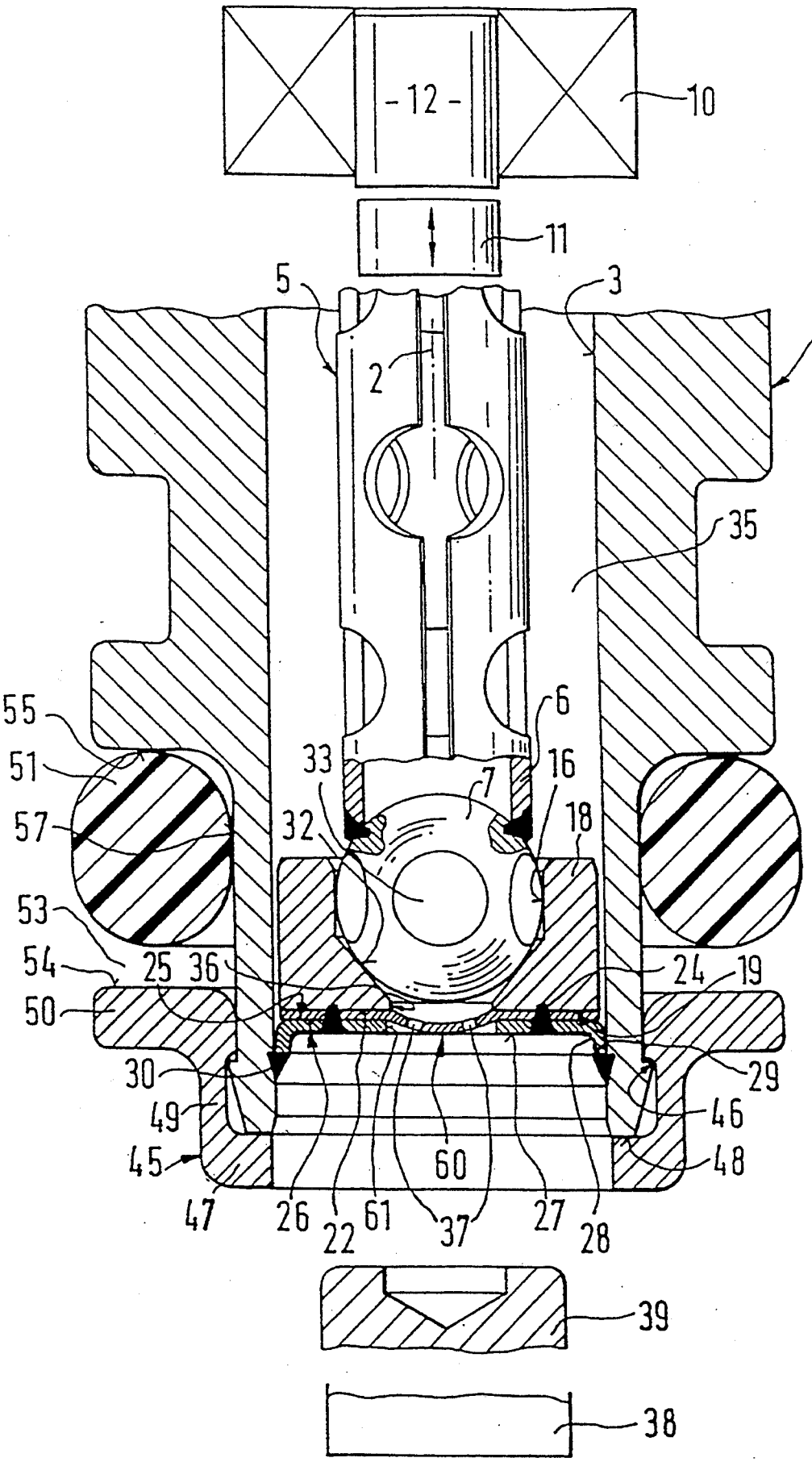
12
10
11
5
3
1
2
35
55
6
51
33
16
7
57
32
18
53
54
25
36
24
19
50
30
29
49
46
45
60
48
47
26
22
61
37
27
28
39
38

FUEL-INJECTION VALVE

State of the Art

The invention is directed to a fuel-injection valve as set forth hereinafter. A fuel-injection valve, in which a perforated disc is fastened to the valve-seat body by means of a continuous welding seam, has already been proposed. In this, the perforated disc has to be made relatively thick, in order to prevent the perforated disc from lifting off as a result of the prevailing fuel pressure, thereby changing the jet pattern of the sprayed fuel in an undesirable way. The relatively large thickness of the perforated disc entails a disadvantage that the fuel issuing from the spray orifices of the perforated disc is not broken up into very fine fuel droplets in the desired way, that is to say optimum fuel treatment is not achieved.

Advantages of the Invention

In contrast to this, the advantage of the fuel-injection valve according to the invention is that a perforated disc thinner than the known perforated discs can be used and leads to an optimum fuel treatment with very fine fuel droplets, without the spray pattern of the sprayed fuel jet being impaired.

Advantageous developments and improvements of the fuel-injection valve indicated hereinafter are possible as a result of the measures listed herein.

It is especially advantageous to make the supporting disc pot-shaped and to connect its continuous holding edge sealingly to the seat carrier after the valve-seat body has been set in its axial position, so that the setting of the valve stroke and consequently of the injected fuel quantity is thereby possible. It is also advantageous for this setting if the holding edge of the supporting disc is bent outwards towards its free end and bears with this free end under radial tension against the wall of a longitudinal orifice of the seat carrier, so that, during the setting operation, the valve-seat body is always held in its axial position, until the desired setting is obtained and, for the final fixing of the holding edge of the supporting disc, is welded to the wall of the longitudinal orifice of the seat carrier.

It is also advantageous if the passage orifice of the supporting disc surrounds as near as possible the region of the perforated disc which is provided with at least one spray orifice and which is arched downstream and made dome-shaped, in order to prevent an undesirable bending of the perforated disc as a result of the prevailing fuel pressure.

DRAWING

An exemplary embodiment of the invention is illustrated in simplified form in the drawing and explained in more detail in the following description.

DESCRIPTION OF THE EXEMPLARY EMBODIMENT

The figure partially shows by way of example a fuel-injection valve for fuel-injection systems of mixture-compressing spark-ignition internal-combustion engines. The fuel-injection valve has a tubular seat carrier 1, in which a longitudinal orifice 3 is formed concentrically relative to a longitudinal valve axis 2. Arranged in the longitudinal orifice 3 is a tubular valve needle 5 which is connected at its downstream end 6 to a spherical valve-closing body 7. The actuation of the fuel-injection valve takes place, for example, electromagnetically in a known way. For the axial movement of the valve needle 5 and therefore for opening and closing the fuel-injection valve, there is an indicated electromagnetic circuit having a magnet coil 10, an armature 11 and a core 12. The armature 11 is connected to the end of the valve needle 5 facing away from the valve-closing body 7 and is aligned with the core 12.

A guide orifice 16 of a valve-seat body 18 serves for guiding the valve-closing body 7 during the axial movement. The circumference of the valve-seat body 18 has a slightly smaller diameter than the diameter of the longitudinal orifice 3 of the seat carrier 1. On one of its end faces, the end face 19 facing away from the valve needle 5, a metallic perforated disc 22 is arranged concentrically on the valve-seat body 18 and is firmly connected to the latter. The perforated disc 22 has, for example, a thickness of 0.1 mm. A supporting disc 26 made thicker than the perforated disc 22 bears against an end face 25 of the perforated disc 22 facing away from the valve-seat body 18. The metallic supporting disc 26 has a pot-shaped cross-sectional shape and has, for example, a thickness of 0.2 mm. A base part 27 of the supporting disc 26 bearing against the end face 25 of the perforated body 22 has adjoining it a continuous holding edge 28 which extends in the axial direction so as to face away from the valve-seat body 18 and which is bent conically outwards as far as an end 29. The holding edge 28 has at its end 29 a slightly larger diameter than the diameter of the longitudinal orifice 3 of the seat carrier 1. The connection of the valve-seat body 18, perforated disc 22 and supporting disc 26 is made, for example, by a continuous and sealing first welding seam 24 formed, for example, by means of a laser. For this reason, good weldability must also be borne in mind in the choice of material for the perforated disc 22 and the supporting disc 26.

With the valve needle 5 pushed into the longitudinal orifice 3 of the seat carrier 1, the valve-seat body 18, with the perforated disc 22 and supporting disc 26 fastened to it, is pushed into the longitudinal orifice 3. Because the diameter of the circumference of the valve-seat body 18 is somewhat smaller than that of the longitudinal orifice 3 of the seat carrier 1, a radial pressure occurs only between the longitudinal orifice 3 and the slightly conically outwardly bent holding edge 28 of the supporting disc 26, the holding edge 28 exerting a radial spring effect on the wall of the longitudinal orifice 3. This prevents chip formation when the valve-seat body 18, together with the perforated disc 22 and supporting disc 26, is being pushed into the longitudinal orifice 3 of the seat carrier 1. In addition, during the production of the valve-seat body 18, there is no need to adhere to a narrow dimensional tolerance on its circumference, since the valve-seat body 18 has a small play in the radial direction in the longitudinal orifice 3 of the seat carrier 1, so that the production costs are reduced substantially in relation to a valve-seat body pressed into the longitudinal orifice 3. The push-in depth of the valve-seat body 18 into the longitudinal orifice 3 of the seat carrier 1 determines the presetting of the stroke of the valve needle 5 guided radially by the guide orifice 16, since, with the magnet coil 10 not energised, one end position of the valve needle 5 is fixed as a result of the bearing of the valve-closing body 7 against a valve-seat face 32 formed downstream of the guide orifice 16 and belonging to the valve-seat body 18. With the magnet coil 10 energised, the other end position of the valve needle 5 is fixed, for example, as a result of the bearing of the armature 11 against the core 12. The travel between these two end positions constitutes the stroke of the valve needle 5.

At its end 29 bearing against the longitudinal orifice 3 of the seat carrier 1, the holding edge 28 of the support disc 26 is connected to the wall of the longitudinal orifice 3, for example by a continuous and sealing second welding seam 30. The second welding seam 30 is produced in exactly the same way as the first welding seam 24, for example by means of a laser, thus ensuring a safe and reliable welding which can be carried out in a simple way and in which the parts to be welded to one another are heated only slightly.

A sealing welding of the valve-seat body 18 and perforated disc 22 or supporting disc 26 and of the supporting disc 26 and seat carrier 1 is necessary so that the medium used, for example a fuel, cannot flow through between the longitudinal orifice 3 of the seat carrier 1 and the circumference of the valve-seat body 18 or between the longitudinal orifice 3 of the seat carrier 1 and the holding edge 28 of the supporting disc 26 directly into an intake line of the internal-combustion engine.

The spherical valve-closing body 7 cooperates with the valve-seat face 32 of the valve-seat body 18, said valve-seat face 32 narrowing, for example conically, in the direction of flow and being formed in the axial direction between the guide orifice 16 and the end face 19 of the valve-seat body 18, and has a plurality of flattened portions 33, preferably five, which allow the medium to flow from the valve interior 35, limited in the radial direction by the longitudinal orifice 3 of the seat carrier 1, to the valve-seat face 32, from where, in the opened state of the valve, the medium passes by way of a short intermediate orifice 36, formed downstream in the valve-seat body 18, to spray orifices 37 of the perforated disc 22. For the exact guidance of the valve-closing body 7 and therefore of the valve needle 5 during the axial movement, the diameter of the guide orifice 16 is designed so that the spherical valve-closing body 7 projects into the guide orifice 16 at a slight radial distance.

The exact setting of the stroke of the valve needle 5 and therefore of the static flow quantity of the medium emitted during the stationary opening state of the valve is carried out on the ready-mounted fuel-injection valve, that is to say, inter alia, the supporting disc 26 welded to the valve-seat body 18 is welded at its holding edge 28 to the seat carrier 1. If the static actual quantity of the medium emitted by the valve and measured by means of a measuring vessel 38 does not correspond to the desired, predetermined desired quantity, then for the exact setting of the stroke of the valve needle 5 the supporting disc 26 is stretched by means of a tool 39 in the axial direction in the region between the second welding seam 30 and the first welding seam 24 and thus, if appropriate, subjected to plastic deformation, until the measured actual quantity of medium corresponds to the predetermined desired quantity of medium. The exact setting of the stroke and of the static 10 flow quantity of a medium emitted during the stationary opening state of the injection valve is thereby carried out in a simple way on the ready-mounted fuel-injection valve.

A protective cap 45 is arranged on the circumference of the seat carrier 1 at its downstream end and is connected to the circumference of the seat carrier 1 by means of a catch connection 46. The protective cap 45 bears with a first radial end portion 47 against an end face 48 of the seat carrier 1. In the direction facing the magnet coil 10, the first radial portion 47 of the protective cap 45 is followed first by an axially extending parallel portion 49 and then by a second radial portion 50 pointing radially outwards. A sealing ring 51 is arranged in an annular groove 53, the side faces of which are formed by one end face 54, the said face facing the magnet coil 10, of the second radial portion 50 of the protective cap 45 and by a radially outwardly pointing bearing face 55 of the seat carrier 1 and the groove bottom 57 of which is formed by the circumference of the seat carrier 1.

The sealing ring 51 serves for sealing off between the circumference of the fuel-injection valve and a valve receptacle not shown, for example the intake line of the internal-combustion engine.

The intermediate orifice 36 downstream of the valve-seat face 32 of the valve-seat body 18 surrounds a middle region 60 of the perforated disc 22, in which there is the at least one spray orifice 37, but four spray orifices 37, for example, are formed. On the other hand, a passage orifice 61 is provided in the supporting disc 26 approximately concentrically relative to the longitudinal valve axis 2 and likewise surrounds the region 60 of the perforated disc 22 on the opposite side. The fuel sprayed through the spray orifices 37 is thus sprayed through the passage orifice 61 of the supporting disc 26. The region 60 of the perforated disc 22 surrounded by the passage orifice 61 of the supporting disc 26 can be arched in the flow direction in such a way that it has the shape of a dome. The relatively thick supporting disc 26, with the exception of the region 60, prevents the perforated disc 22 from bending as a result of the pressure force of the fuel, so that the thickness of the perforated disc 22 can be selected smaller than hitherto, with the result that the treatment of the sprayed fuel at the spray orifices 37 improves as a result of the formation of very fine fuel droplets. The first welding seam 24 is at a sufficiently large radial distance from the region 60 of the perforated disc 22 to prevent deformations from forming in the region 60. The axial distance between the region 60 of the perforated disc 22 and the lower end of the valve-closing body 7 is kept as small as possible, so as to form as small a dead volume as possible.

We claim:

1. A fuel-injection valve for fuel-injection systems of internal-combustion engines, having a moveable valve needle, a valve-seat body which is connected to a seat carrier and which has a valve-seat face cooperating with the valve needle, a thin metallic perforated disc is welded to the valve-seat body downstream of the valve-seat face at and end face (19) of the valve-seat body and having at least one spray orifice, a metallic supporting disc (26) having a thickness greater than the perforated disc (22) is arranged on an end face (25) of the perforated disc (22) facing away from the valve-seat body (18) and is welded, together with the perforated disc (22), to the valve-seat body (18) at said end face (19) by means of a continuous welding seam (24), and the supporting disc (26) has a passage orifice (61) which surrounds a region (60) of the perforated disc (22) having at least one spray orifice (37).

2. A fuel-injection valve according to claim 1, in which the supporting disc (26) is made pot-shaped and has a continuous holding edge (28) which extends in an axial direction so at to face away from the valve-seat body (18) and which is sealingly connected at a free end (29) to a wall of a longitudinal passage (3) of the seat carrier (1).

3. A fuel-injection valve according to claim 2, in which the holding edge (28) of the supporting disc (26) is bent outwards to provide said free end (29), said holding edge (28) is non-installed state has a diameter on its free end (29) which is greater than the diameter of the longitudinal passage (3) of the seat carrier (1).

4. A fuel-injection valve according to claim 1, in which the region (60) of the perforated disc (22) which is surrounded by the passage orifice (61) of the supporting disc (26) and which contains the at least one spray orifice (37) is arched in a downstream direction in the form of a dome.

* * * * *